United States Patent [19]

Otomura et al.

[11] Patent Number: 4,764,442

[45] Date of Patent: Aug. 16, 1988

[54] DUAL LAYER ELECTRODE USED WITH ELECTROPHOTOGRAPHIC PHOTOCONDUCTOR

[75] Inventors: Satoshi Otomura, Chiba; Hideki Akiyoshi, Numazu, both of Japan

[73] Assignee: Ricoh Company, Ltd., Tokyo, Japan

[21] Appl. No.: 934,800

[22] Filed: Nov. 25, 1986

[30] Foreign Application Priority Data

Nov. 28, 1985 [JP] Japan ..... 60-266059

[51] Int. Cl.[4] ..... G03G 5/06; G03G 5/14

[52] U.S. Cl. ..... 430/63; 430/58; 428/621; 428/626

[58] Field of Search ..... 430/63; 428/621, 626; 427/123, 125

[56] References Cited

U.S. PATENT DOCUMENTS

| | | | |
|---|---|---|---|
| 2,686,354 | 8/1954 | Lundin | 428/621 X |
| 2,809,294 | 10/1957 | Vyverberg | 430/63 |
| 3,202,588 | 8/1965 | Fromson | 428/621 X |
| 3,481,840 | 12/1969 | Lupinski et al. | 428/626 X |
| 3,870,516 | 3/1975 | Smith et al. | 430/58 X |
| 3,871,882 | 3/1975 | Wiedemann | 430/59 |
| 4,144,360 | 3/1979 | Birkle et al. | 427/123 |
| 4,499,152 | 2/1985 | Green et al. | 427/123 X |
| 4,537,846 | 8/1985 | Mimura et al. | 430/63 X |
| 4,585,901 | 4/1986 | Miller | 428/626 X |

FOREIGN PATENT DOCUMENTS

| | | | |
|---|---|---|---|
| 2754248 | 7/1979 | Fed. Rep. of Germany | 428/626 |
| 59-107055 | 6/1984 | Japan | 428/626 |
| 710968 | 6/1954 | United Kingdom | 427/123 |

*Primary Examiner*—Roland E. Martin

*Attorney, Agent, or Firm*—Oblon, Fisher, Spivak, McClelland & Maier

[57] ABSTRACT

An electrode for use with an electrophotographic photoconductor comprising a non-aluminum metal layer and an aluminum layer which are successively formed on a substrate, thereby constituting a double-layered electrode, and an electrophotographic photoconductor including the double layered electrode are disclosed.

6 Claims, No Drawings

DUAL LAYER ELECTRODE USED WITH ELECTROPHOTOGRAPHIC PHOTOCONDUCTOR

BACKGROUND OF THE INVENTION

The present invention relates to an electrode for use with an electrophotographic photoconductor, and an electrophotographic photoconductor using the electrode.

In electrophotography, there is employed a photoconductor comprising a substrate made of, for example, glass or a plastic, an electrode in the form of an electroconductive layer formed thereon, for example, by depositing a metal or by coating an electroconductive paint, and a photoconductive layer formed on the electroconductive layer.

The material and shape of the above electrode are appropriately chosen in accordance with the characteristics of the photoconductor and the employed method of fabricating the photoconductor.

When a photoconductive layer comprising a selenium-based material is employed, in most cases aluminum or an aluminum alloy is used as the material for the electrode, which is worked into the form of a drum.

When a photoconductive layer is formed by coating a photoconductive layer coating liquid, a metal layer, deposited by vacuum evaporation or sputtering on a plastic film, may be used as the electrode. In particular, an aluminum-metallized layer formed on a polyethylene terephthalate film is widely used as an electrode of an organic photoconductor.

The reasons why aluminum is widely used as the electroconductive material for the electrode are that (1) aluminum can be relatively easily worked into a thin film on a plastic film, (2) non-ohmic contact is easily attained at the interface between an aluminum electrode and a photoconductive layer formed thereon, (3) when aluminum is employed as the material for the electrode, high charge acceptance potential can be obtained in the electrophotographic photoconductor without impairing the fundamental electrophotographic properties thereof, and (4) aluminum is not high priced.

One of the representative organic electrophotographic photoconductors (hereinafter referred to as the OPC) employed at present is of the so-called function-separation type, which comprises a substrate, an electrode formed on the substrate, a charge generating layer formed on the electrode, and a charge transporting layer formed on the charge generating layer. Specifically, a representative example of the OPC, which is most widely employed at present, comprises a substrate made of polyethylene terephthatalate, an aluminum layer serving as the electrode, a charge generating layer and a charge transporting layer which are successively overlaid on the substrate. The charge transporting layer generally comprises a triphenylamine type or hydrazone type positive-hole-moving material dissolved in a polymer. Since an electron-moving organic compound for use in the charge transporting layer that can be employed in practice has not been discovered, an electrophotographic photoconductor of the function-separation type using the OPC is usually employed under application of negative charge. In other words, in the course of the formation of a latent electrostatic image on the photoconductive layer, positive holes move from the charge generating layer toward the charge transporting layer, so that they are quenched at the surface of the photoconductive layer.

The inventors of the present invention have discovered that several metals, in particular, aluminum, employed as the electrode of an electrophotographic photoconductor under application of negative charge have the following serious shortcoming. When the surface of the photoconductive layer is charged to a negative polarity, a positive charge is induced on the back side thereof on the side of the electrode. When the photoconductive layer is exposed to a light image and the corresponding latent electrostatic image is formed thereon, the electric charges at the surface of the photoconductive layer dissipate through the electrode which is positioned adjacent to the charge generating layer. When this is repeated many times while in use, the electrode is gradually subjected to anodic oxidation. Eventually, the electrode is oxided so that the resistivity thereof highly increases, losing the function as the electrode.

In particular, when the photoconductor is in the form of a sheet comprising a transparent substrate, and charge quenching for image transfer and cleaning is performed by exposing the photoconductive layer to light from the side of the substrate, the electrode is designed so as to be transparent with a thickness of several hundred Angstroms for easy charge quenching. When the thickness of the electrode is in the above order, the electrode is almost entirely oxidized very quickly during the dissipation of electric charge from the charge generating layer into the electrode. For instance, in the case where the average spectral transmittance of an aluminum electrode in the form of a thin layer is 40% in the visible light region, the aluminum electrode is almost entirely oxidized when an electric charge of $3\times10^{-2}$ C/cm$^2$ has passed through the electrode.

When the electrode has a thickness greater than the above-mentioned thickness, for instance, when the thickness is in the order of micrometer, the electrode is scarcely affected by the above-mentioned oxidation. This is because the above-mentioned oxidation proceeds only at the interface between the electrode and the charge generating layer and the oxidation does not proceed to the extent that the electrode is entirely oxidized. The result is that the necessary electric conductivity of the electrode is maintained by the non-oxidized portion of the electrode. In this case, however, the electrode is not transparent at all because of the above-mentioned thickness.

Even when the photoconductive layer is positively charged for the formation of latent electrostatic image, the photoconductive layer is charged negatively for quenching the positive charge in order to facilitate image transfer to a transfer sheet or to clean the surface of the photoconductive layer. The above problem is unavoidable in both negative charging and positive charging.

Noble metals such as Au, Pt and Pd are of course resistant to oxidation. Metals such as Cr, Ni, Ti, Co and W are hardly oxidized, and even if they are oxidized, the effect of the oxidization on the electric conductivity is negligible. However, when these metals are employed as the material of the electrode, positive hole injection from the substrate to the photoconductive layer is so considerable that the charge acceptance potential of the photoconductive layer is significantly decreased and the rising of the charging of the photoconductive layer is caused to slow down, which occur before the deterioration of the photoconductive layer itself, which may be caused by the above-mentioned oxidation of the electrode.

It has been confirmed by the inventors of the present invention that Ni-based, Co-based and Fe-based alloys are resistant to acids, heat and corrosion and are relatively good materials for the electrode of electrophotographic photoconductor. In particular, Hastelloy, Monel, Illium, and Monel Metal, which are Ni-based alloys, are good. However, when these alloys are employed, more hole injection takes place as compared with the case where aluminum is employed. Further, these alloys are expensive.

SUMMARY OF THE INVENTION

It is therefore an object of the present invention to provide a material for an electrode of an electrophotographic photoconductor, having excellent fundamental electric characteristics and high durability with minimized deterioration during repeated use over an extended period of time.

Another object of the present invention is to provide a material for an electrode of a transparent electrophotographic photoconductor employed under application of negative charge, having the above mentioned excellent characteristics durability.

A further object of the present invention is to provide an electrophotographic photoconductor using the above-mentioned electrode.

The first two objects of the present invention have been achieved by a double layered electrode comprising a non-aluminum metal layer formed on a substrate, and an aluminum layer formed on the non-aluminum metal layer. This electrode can be made transparent in ultraviolet, visible and infrared regions when it is used in combination with a transparent substrate. The electrode according to the present invention is stable in performance and free from deterioration of the characteristics, oxidation and fatigue, even if it is used in repetition over an extended period of time.

The third object of the present invention is achieved by an electrophotographic photoconductor comprising a substrate, the above-mentioned double layered electrode formed on the substrate, consisting of a non-aluminum metal layer overlaid on the substrate, and an aluminum layer formed on the non-aluminum metal layer, and an organic photoconductive layer.

DETAILED DESCRIPTION OF THE PREFERRED EMBODIMENTS

In the electrode according to the present invention, the non-aluminum metal layer is made of a metal other than aluminum. Examples of such a metal are Ti, V, Cr, Fe, Co, Ni, Cu, Zr, Nb, Mo, Ru, Rh, Pd, Ag, Sn, Sb, Ta, W, Ir, Au and Pt. Of these metals, Ti, Cr, Co, Ni and W are most preferable for use.

It is preferable that the non-aluminum metal layer comprise at least one of the above metals as the main component. The choice of a particular metal from the above mentioned metals for use in the non-aluminum metal layer and the setting of the thickness of the electrode itself depend upon the photoconductive layer to be formed on the electrode.

It is preferable that the electrode consisting of the non-aluminum and the aluminum layer have a spectral transmittance of 5 to 75%, more preferably 20 to 60%. It is also preferable that the electrode and the substrate be transparent as a whole.

When constructing the electrode according to the present invention, the spectral transmittance, the electric characteristics including the electric resistivity, and the film formation property should be taken into consideration. Of these factors, the choice of a metal for use in the non-aluminum metal layer is less important than the other factors because the electric characteristics of the electrode predominantly depend upon the electric characteristics of the aluminum layer formed on the non-aluminum metal layer.

The main reason why the electrode according to the present invention has excellent fundamental electric characteristics and high stability in quality is that even if oxidation occurs at the interface between the photoconductive layer (in the case of a function-separation type photoconductor, a charge generating layer), the electric conductivity of the non-aluminum metal layer in the direction of the thickness thereof below the photoconductive layer can be maintained. In the case of a conventional electrophotographic photoconductor, a comparatively thick aluminum layer is employed for the same purpose, although in this case the aluminum layer and the substrate become opaque.

The electrode according to the present invention is particularly suitable for use with an organic photoconductive layer. There are two types of organic photoconductive layers, a dispersed type and a double layered type. An organic photoconductive layer of the dispersed type is a single layer which is overlaid on the electrode and generally comprises a charge generating material and a charge transporting medium in which the charge generating material is dispersed. By contrast, an organic photoconductive layer of the double-layered type comprises a charge generating layer which is overlaid on the electrode and contains a charge generating material, and a charge transporting layer which is overlaid on the charge generating layer and contains a charge transporting material.

The present invention will now be explained in detail with reference to the following examples according to the present invention. The present invention is, of course, not limited to these examples.

EXAMPLE 1

A non-aluminum metal layer consisting of Cr was deposited by sputtering on a polyester film having a thickness of 75 μm in such a manner that the mean light transmittance thereof in the visible light region (400 to 700 nm) was 70%.

On this Cr layer, an aluminum layer was formed by vacuum sputtering in such a manner that the entire transmittance of the thus formed double-layered electrode was 35% in the visible light region. In this case, the light transmittance of the aluminum layer alone was about 46% in the visible light region.

A charge generating layer consisting of 2.5 parts by weight of a bisazo pigment having the following formula (I) and 1 part by weight of a butyral resin in which the bisazo pigment was dispersed was formed with a thickness of 0.3 μm by blade coating on the double-layered electrode.

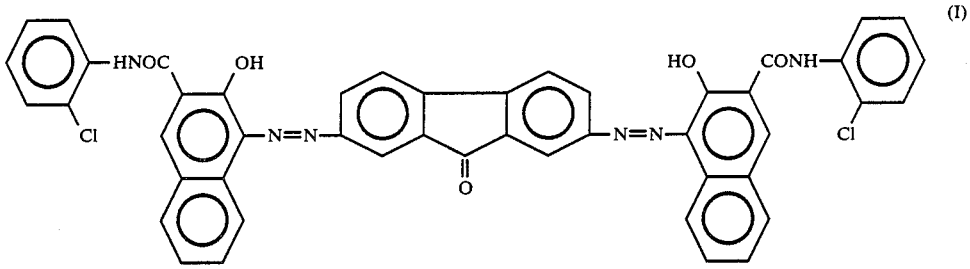

(I)

Finally, a charge transporting layer consisting of 9 parts by weight of a styryl compound having the following formula (II) and 10 parts by weight of a polycarbonate resin in which the styryl compound was dispersed was formed with a thickness of 20 μm by blade coating on the above charge generating layer, whereby an electrophotographic photoconductor No. 1 was prepared.

(II)

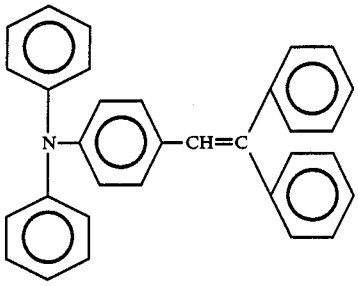

The electrophotographic properties of the electrophotographic photoconductor No. 1 were measured by Paper Analyzer (made by Kawaguchi Electro Works) in a dynamic mode by subjecting the photoconductor to charging, dark decay and exposure to light under the conditions that the charging current was −24 μÅ, the exposure of the photoconductor to light was 4.5 lux, and the charging, the dark decay and the exposure were respectively performed for 20 seconds, 20 seconds and 30 seconds. The results are shown in Table 1 as being initial values.

By use of the above Paper Analyzer, the above prepared electrophotographic photoconductor No. 1 was then subjected to charging, dark decay and exposure to light under the conditions that the charging current was −9.6 μÅ, the exposure of the photoconductor to light was 45 lux, and the charging, the dark decay and the exposure were performed for 30 minutes, 1 hour, 2 hours, 5 hours and 10 hours. The results are also shown in Table 1.

COMPARATIVE EXAMPLE 1

Example 1 was repeated except that the double-layered electrode formed in Example 1 was replaced by an aluminum layer with a spectral transmittance of 35% which was deposited by vacuum evaporation, whereby a comparative electrophotographic photoconductor No. 1 was prepared.

The thus prepared comparative electrophotographic photoconductor No. 1 was evaluated in the same manner as in Example 1. The result was that the residual potential (VR) after 10 hours was more than 9 times the residual potential at the same time of the electrophotographic photoconductor No. 1 prepared in Example 1.

COMPARATIVE EXAMPLE 2

Example 1 was repeated except that the double-layered electrode formed in Example 1 was replaced by a Cr layer with a spectral transmittance of 35% which was deposited by sputtering, whereby a comparative electrophotographic photoconductor No. 2 was prepared.

The thus prepared comparative electrophotographic photoconductor No. 2 was evaluated in the same manner as in Example 1. The result was that the dark decay (DD) of the photoconductor became excessive due to the fatigue thereof by the time the 2 hour-exposure was finished and the charge acceptance potential considerably decreased. Therefore, the evaluation tests were no longer conducted.

EXAMPLE 2

Example 1 was repeated except that the non-aluminum metal layer consisting of Cr deposited in Example 1 was replaced by a non-aluminum metal consisting of Ti and the entire transmittance of the electrode was 35% in the visible light region, whereby an electrophotographic photoconductor No. 2 was prepared.

The electrophotographic photoconductor No. 2 was evaluated in the same manner as in Example 1. The result was that the obtained characteristics were as good as in Example 1.

COMPARATIVE EXAMPLE 3

Example 1 was repeated except that the double-layered electrode formed in Example 1 was replaced by a Ti layer with a spectral transmittance of 35% which was deposited by sputtering, whereby a comparative electrophotographic photoconductor No. 3 was prepared.

The thus prepared comparative electrophotographic photoconductor No. 3 was evaluated in the same manner as in Example 1. The result was that the photoconductive characteristics of the photoconductor was deteriorated with time almost in the same manner as in Comparative Example 2.

EXAMPLE 3

Example 1 was repeated except that the non-aluminum metal layer consisting of Cr deposited in Example 1 was replaced by a non-aluminum metal consisting of a nickel alloy (Hastelloy C) and the entire transmittance of the electrode was 35% in the visible light region, whereby an electrophotographic photoconductor No. 3 was prepared.

The electrophotographic photoconductor No. 3 was evaluated in the same manner as in Example 1. The result was that the obtained characteristics were as good as in Example 1.

COMPARATIVE EXAMPLE 4

Example 1 was repeated except that the double-layered electrode formed in Example 1 was replaced by a nickel alloy (Hastelloy C) layer with a spectral transmittance of 35% which was deposited by sputtering, whereby a comparative electrophotographic photoconductor No. 4 was prepared.

The thus prepared comparative electrophotographic photoconductor No. 4 was evaluated in the same manner as in Example 1. The result was that the dark decay of the photoconductor became considerable due to the fatigue thereof as shown in Table 1.

TABLE 1

| Examples | Material (s) of Electrode | Properties | Initial | 0.5 hrs | 1 hr | 2 hrs | 5 hrs | 10 hrs |
|---|---|---|---|---|---|---|---|---|
| Example 1 | Cr—Al | $V_{max}$ | 1280 | 1250 | 1250 | 1260 | 1300 | 1500 |
| Photoconductor | | DD | 0.85 | 0.81 | 0.80 | 0.80 | 0.80 | 0.88 |
| No. 1 | | E(½) | 0.77 | 0.77 | 0.78 | 0.78 | 0.79 | 0.85 |
| | | VR | 0 | 2 | 4 | 10 | 30 | 40 |
| Comparative | Al | $V_{max}$ | 1280 | 1290 | 1330 | 1390 | 1650 | 1730 |
| Example 1 | | DD | 0.86 | 0.83 | 0.82 | 0.83 | 0.89 | 0.95 |
| Comp. Photo- | | E(½) | 0.77 | 0.77 | 0.78 | 0.80 | 0.80 | 0.87 |
| conductor No. 1 | | VR | 0 | 8 | 20 | 50 | 190 | 370 |
| Comparative | Cr | $V_{max}$ | 998 | 514 | 274 | 206 | | |
| Example 2 | | DD | 0.78 | 0.09 | 0.06 | 0.06 | | |
| Comp. Photo- | | E(½) | 0.77 | — | — | — | | |
| conductor No. 2 | | VR | 0 | 2 | 2 | 2 | | |
| Example 2 | Ti—Al | $V_{max}$ | 1290 | 1260 | 1270 | 1270 | 1290 | 1350 |
| Photoconductor | | DD | 0.86 | 0.84 | 0.82 | 0.80 | 0.78 | 0.78 |
| No. 2 | | E(½) | 0.76 | 0.77 | 0.77 | 0.77 | 0.78 | 0.80 |
| | | VR | 0 | 2 | 5 | 10 | 25 | 50 |
| Comparative | Ti | $V_{max}$ | 1010 | 830 | 780 | 770 | 820 | 1000 |
| Example 3 | | DD | 0.77 | 0.54 | 0.45 | 0.37 | 0.30 | 0.47 |
| Comp. Photo- | | E(½) | 0.76 | 0.20 | — | — | — | — |
| conductor No. 3 | | VR | 0 | 0 | 2 | 6 | 25 | 45 |
| Example 3 | Hastelloy | $V_{max}$ | 1270 | 1210 | 1240 | 1250 | 1260 | 1300 |
| Photoconductor | —Al | DD | 0.87 | 0.80 | 0.80 | 0.79 | 0.75 | 0.74 |
| No. 3 | | E(½) | 0.77 | 0.76 | 0.76 | 0.77 | 0.78 | 0.79 |
| | | VR | 0 | 5 | 9 | 16 | 37 | 65 |
| Comparative | Hastelloy | $V_{max}$ | 1024 | 915 | 880 | 820 | 770 | 750 |
| Example 4 | | DD | 0.83 | 0.65 | 0.50 | 0.30 | 0.20 | 0.10 |
| Comp. Photo- | | E(½) | 0.75 | 0.71 | 0.70 | 0.68 | — | — |
| conductor No. 4 | | VR | 0 | 2 | 7 | 5 | 10 | 20 |

$V_{max}$: Potential after Charging for 20 sec.
DD: Dark Decay after 20 sec.
E(½): Exposure (lux sec) required for the potential (800 V) to be reduced to one-half the potential.
VR: Residual Potential after Exposure for 30 sec.

What is claimed is:

1. An electrophotographic photoconductor comprising:

a non-metal substrate, a double-layered electrode formed on said substrate, consisting of a non-aluminum metal layer overlaid on said substrate, and an aluminum layer formed on said non-aluminum metal layer, and an organic photoconductive layer comprising a charge generating material and a charge transporting material, wherein said double-layered electrode and said substrate are both transparent at least in an ultraviolet region, in a visible light region or in an infrared region.

2. The electrophotographic photoconductor as claimed in claim 1, wherein said organic photoconductive layer comprises a charge generating material and a charge transporting medium in which said charge generating material is dispersed.

3. The electrophotographic photoconductor as claimed in claim 1, wherein said organic photoconductive layer comprises a charge generating layer which is overlaid on said substrate and comprises a charge generating material, and a charge transporting layer which is overlaid on said charge generating layer and comprises a charge transporting material.

4. The electrophotographic photoconductor as claimed in claim 1, wherein said double-layered electrode has a transmittance ranging from 5% to 75% at least in an ultraviolet region, in a visible light region or in an infrared region.

5. The electrophotographic photoconductor as claimed in claim 1, wherein said non-aluminum metal layer comprises as the main component at least one metal selected from the group consisting of Ti, V, Cr, Fe, Co, Ni, Cu, Zr, Nb, Mo, Ru, Rh, Pd, Ag, Sn, Sb, Ta, W, Ir, Au and Pt.

6. The electrophotographic photoconductor as claimed in claim 1, wherein said non-aluminum metal layer comprises as the main component at least one metal selected from the group consisting of Ti, Cr, Co, Ni and W.

* * * * *